United States Patent [19]

Solomon et al.

[11] Patent Number: 4,993,089

[45] Date of Patent: Feb. 19, 1991

[54] BED RAIL MECHANISM

[75] Inventors: Robert A. Solomon, Kalamazoo; Stanley J. Axe, Sr., Plainwell, both of Mich.

[73] Assignee: AmFab, Incorporated, Division of Bissell, Inc., Kalamazoo, Mich.

[21] Appl. No.: 496,784

[22] Filed: Mar. 21, 1990

[51] Int. Cl.[5] ..... A47C 21/08

[52] U.S. Cl. ..... 5/430; 5/428

[58] Field of Search ..... 5/425, 428, 430; 297/417

[56] References Cited

U.S. PATENT DOCUMENTS

| | | | |
|---|---|---|---|
| 523,287 | 7/1894 | Kollenberg . | |
| 1,173,051 | 2/1916 | Smith . | |
| 1,240,201 | 9/1917 | Haskes . | |
| 1,479,539 | 1/1924 | Hines . | |
| 1,508,989 | 9/1924 | Roth . | |
| 1,620,418 | 3/1927 | Wiarda . | |
| 1,761,214 | 6/1930 | Koeck . | |
| 1,887,653 | 11/1932 | Lonschein . | |
| 1,992,733 | 2/1935 | Bayer | 5/100 |
| 2,554,422 | 5/1951 | Richards et al. | 4/239 |
| 2,828,098 | 3/1958 | Lehmann | 248/293 |
| 2,882,109 | 4/1959 | Eves et al. | 311/86 |
| 3,100,899 | 8/1963 | Wright | 5/430 |
| 3,248,744 | 5/1966 | Hutt . | |
| 3,249,387 | 5/1966 | Pivacek | 297/417 |
| 3,351,369 | 11/1967 | Hogstrom | 292/263 |
| 3,585,659 | 6/1971 | Burst et al. . | |
| 3,930,273 | 1/1976 | Stern . | |
| 3,932,903 | 1/1976 | Adams et al. | 5/100 |
| 3,971,083 | 7/1976 | Peterson . | |
| 4,217,670 | 8/1980 | Sciongay, Sr. et al. | 5/425 |
| 4,307,913 | 12/1981 | Spiegelhoff | 297/417 |
| 4,612,679 | 9/1986 | Mitchell | 5/430 X |

FOREIGN PATENT DOCUMENTS 746313 3/1956 United Kingdom .

*Primary Examiner*—Michael F. Trettel

*Attorney, Agent, or Firm*—Price, Heneveld, Cooper, DeWitt & Litton

[57] ABSTRACT

A bed rail support and mounting mechanism for attachment to a bed frame comprising a folding multi-link framework, a folding diagonal locking linkage and a spring counterbalance whereby a bed rail may be easily lowered or raised and locked in position. A bed including the mechanism is also disclosed.

19 Claims, 2 Drawing Sheets

BED RAIL MECHANISM

BACKGROUND OF THE INVENTION

The present invention relates to bed safety rail mechanisms such as are commonly found on hospital beds. Bed safety rails are typically of a rectangular or trapezoidal configuration and attached to the bed frame by a mechanism which allows the bed rail to be raised and lowered.

The typical bed rail mechanism uses vertical support members which are slidably attached to the bed frame such that the bed rail can be raised and lowered vertically. These sliding-type mechanisms typically lock the bed rail in the raised position by use of a pin engaging a hole in the vertical support member or by a clamping means.

The above-described mechanism has been subject to the loss of component parts. Further, such bed rails can be relatively heavy and awkward for a given operator to raise and lower. If such bed rails are not lowered evenly, they tend to bind, become difficult to move and can jam in an undesired position.

SUMMARY OF THE INVENTION

In the present invention, a multi-link mechanism is used to attach a bed rail to a bed frame so that the rail can be easily raised to its elevated position and locked in place. Alternatively, the rail can be easily released and placed in the lowered position. The mechanism uses a movable framework to guide the bed rail in an arcuate path between its elevated and lowered positions. A diagonal linkage is provided to lock the mechanism and bed rail in the elevated position. A counterbalance mechanism is also provided so the operator need not struggle with the weight of the rail.

These and other objects, features and advantages of the invention will be more clearly understood and appreciated by reference to the written specification and appended drawings.

DESCRIPTION OF THE PREFERRED EMBODIMENT

Figure 1:
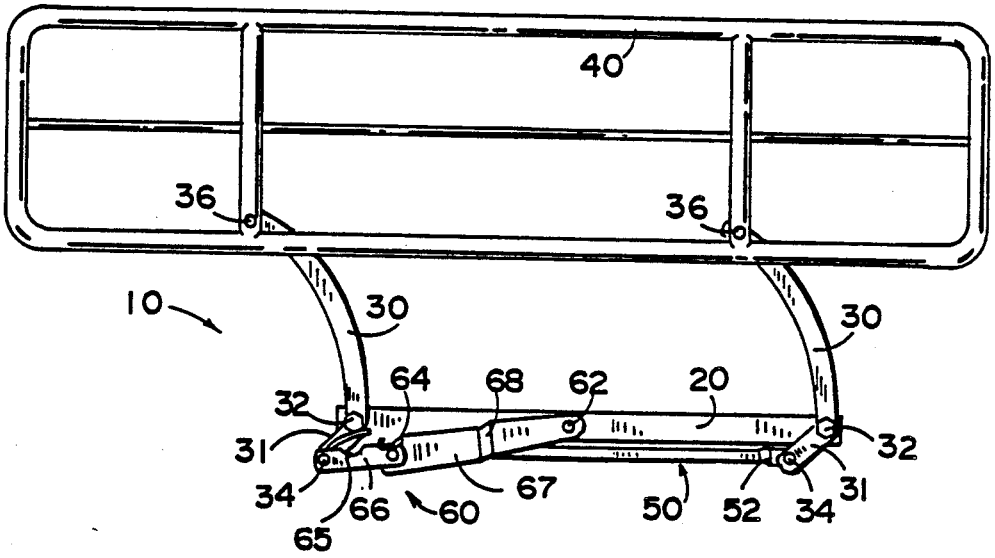
FIG. 1 shows a fragmentary, side elevation view of a portion of a hospital-type bed with the bed rail mechanism of the present invention attached to the hospital bed frame and supporting a bed rail in the elevated position.
Figure 3:
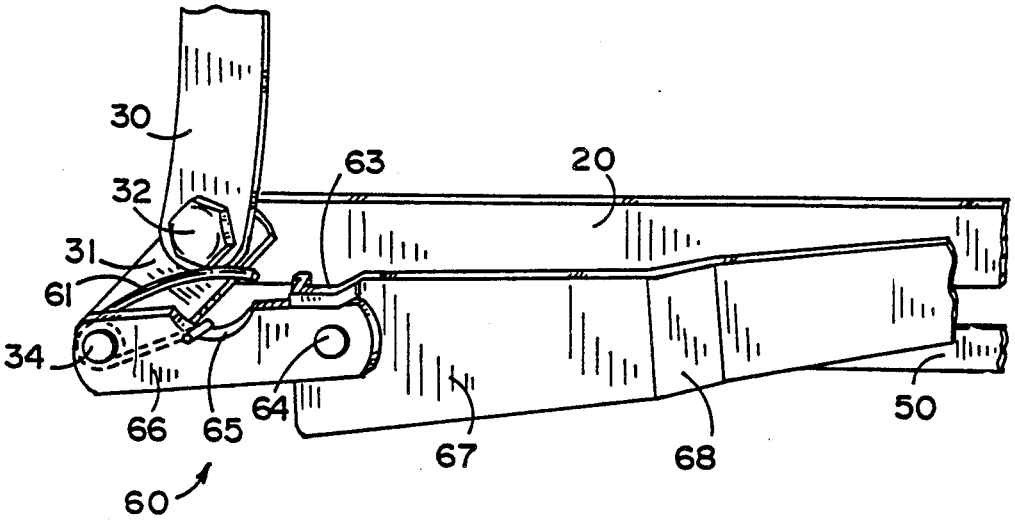
FIG. 3 shows a detail of the locking mechanism in the locked position.

Generally referring to FIGS. 1 and 3, the bed rail mechanism 10 of the present invention is attached to a bed 12 by fastening, preferably bolting, a mounting bar 20 to the bed frame 14. A pair of bed rail support arms 30, preferably arcuately shaped with an offset portion 31 at one end, are pivotally connected with each end of mounting bar 20 at 32, near the place where offset portion 31 joins arm 30. A bed rail 40 is pivotally connected near the end of each arm 30, at 36. A stabilizer bar 50 is pivotally connected at 34 between the ends of offset portions 31 of arms 30. Stabilizer bar 50 has an offset portion 52 at each end such that stabilizer bar 50 is set back from pivots 34.

A folding diagonal linkage 60 is used to lock rail 40 in the elevated position. Folding linkage 60 has a link 66 which is pivotally connected at 34 to stabilizer bar 50 and to the end of offset portion 31 of arm 30. Folding linkage 60 also has a second link 68 which is pivotally connected at 62 to bar 20 and at 64 to link 66. Link 68 has a first portion adjacent bar 20, to stabilize the movement of the link, and an offset portion 67 such that pivots 64 and 34 are aligned and folding linkage 60 can move freely. Referring to the detail shown in FIG. 3, an offset stop 63 is formed at the upper left corner of link 68 which limits the movement of folding linkage 60 when bed rail 40 is raised. A coil spring 61 biases folding linkage 60 to the locked position. Spring 61 is coiled around pivot pin 34 and has two extending legs. A first leg extends under and presses against pivot 32 while a second leg has a bent end portion which presses downward against a notch 65, found in the top edge of link 66. Spring 61 tends to keep folding linkage 60 locked when bed rail 40 is in the raised position. Downward pressure on bed rail 40, such as caused by a patient falling upon the rail or climbing over the rail, will cause link 66 to be held firmly against stop 63.

Figure 2:
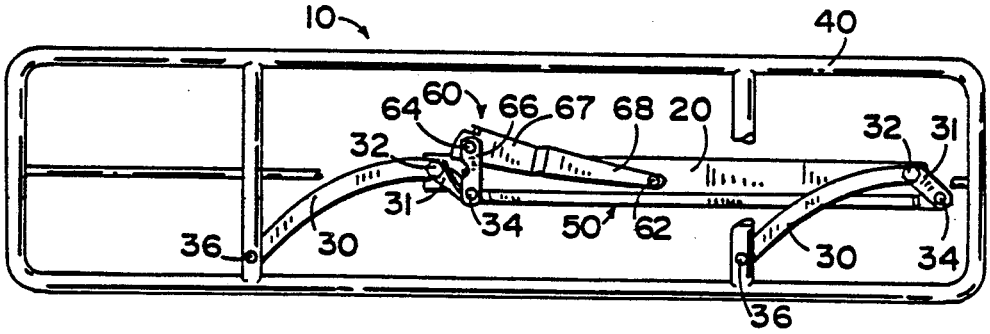
FIG. 2 is the view of FIG. 1 with the invention holding the bed rail in the lowered position.
Figure 4:
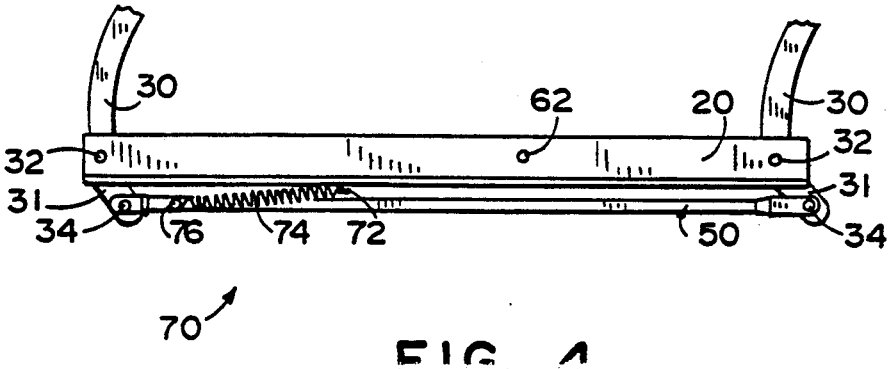
FIG. 4 shows a rear elevation of a portion of the bed rail mechanism in the elevated position, showing a counterbalance spring.

In operation, bed rail 40 is lowered from the elevated position (FIG. 1) by lifting on link 68 near pivot 64. Arms 30 rotate in a counterclockwise direction about pivots 32, as shown in FIG. 1, and folding linkage 60 folds about pivot 64. A counterbalance spring 74 for bed rail 40 and mechanism 10 is shown in FIG. 4. A first end of spring 74 is connected to bar 20 at an intermediate position 72. A second end of spring 74 is connected to stabilizer bar 50, at a position 76, near pivot 34. As shown in FIG. 4, arms 30 rotate in a clockwise direction, causing spring 74 to stretch as spring connecting positions 72 and 76 move apart. The tensile force provided by spring 74 tends to counter the force exerted by the weight of bed rail 40. Referring to FIG. 1, arms 30 continue to rotate about pivots 32 until bar 50 contacts bar 20 and rail 40 is stopped at its lowered position (FIG. 2).

While the Figures and the description of the preferred embodiment refer to an embodiment of the invention specifically applicable to the left side of a bed, a mirror image to that presented above and in the Figures would be specifically applicable to installation on the right side of a bed.

The above description is considered that of the preferred embodiment only. Modifications of the invention will occur to those who make or use the invention. Therefore, it is understood that the embodiment shown in the drawings and described above is merely for illustrative purposes and is not intended to limit the scope of the invention, which is defined by the following claims.

The embodiments of the invention in which an exclusive property or privilege is claimed are defined as follows.

1. A mechanism for connecting a bed rail to a bed frame such that the bed rail can be moved between a lowered position and a raised and locked position comprising:

a mounting bar for mounting said mechanism to said bed frame;

a pair of bed rail support arms, each having a first and a second end, said support arms being pivotally connected at an intermediate point, near said second end, to each end of said mounting bar;

a bed rail having first and second ends and being pivotally connected, near each end, to said first end of each said support arm;

a stabilizer bar pivotally connected between said second ends of said support arms; and a linkage connected at one point to said mounting bar and connected at another point spaced from said one point to said stabilizer bar for locking said mechanism in the raised position.

2. The mechanism of claim 1 wherein said linkage includes a first link pivotally connected at a first end to said stabilizer bar and pivotally connected at a second end to a first end of a second link that is pivotally connected at a second end to said mounting bar.

3. The mechanism of claim 2 wherein said linkage includes a stop such that said linkage cannot be manipulated beyond a substantially straightened position when said bed rail is in the elevated position.

4. The mechanism of claim 3 wherein said stop is a projecting portion of said second link near said first end of said second link.

5. The mechanism of claim 3 further including a means for biasing said linkage to a substantially straightened position when said bed rail is in the elevated position.

6. The mechanism of claim 4 wherein said means for biasing is a spring which tends to bias said first link against the stop on said second link.

7. The mechanism of claim 1 further including a counterbalance device to counteract the weight of said bed rail.

8. The mechanism of claim 7 wherein said counterbalance is a spring connected between said mounting bar and said stabilizer bar.

9. The mechanism of claim 1 further including a counterbalance spring connected between said mounting bar and said stabilizer bar to counteract the weight of said bed rail;

wherein said linkage is a first link pivotally connected at a first end to said stabilizer bar and pivotally connected at a second end to a first end of a second link that is pivotally connected at a second end to said mounting bar;

wherein said linkage includes a stop such that said linkage cannot be manipulated beyond a straightened position when said bed rail is in the elevated position; and wherein said linkage has a spring for biasing said linkage to a substantially straightened position.

10. A hospital-type bed comprising:

a bed frame;

a mechanism for connecting a bed rail to said bed frame such that the bed rail can be moved between a lowered position and a raised and locked position comprising:

a mounting bar for mounting said mechanism to said bed frame;

a pair of bed rail support arms, each having a first and a second end, said support arms being pivotally connected at an intermediate point, near said second end to each end of said mounting bar;

a bed rail having first and second ends and being pivotally connected, near each end, to said first end of said support arms;

a stabilizer bar pivotally connected between said second ends of said support arms; and a linkage connected at one point to said mounting bar and connected at another point spaced from said one point to said stabilizer bar for locking said mechanism in the raised position.

11. The mechanism of claim 10 wherein said linkage includes a first link pivotally connected at a first end to said stabilizer bar and pivotally connected at a second end to a first end of a second link that is pivotally connected at a second end to said mounting bar.

12. The mechanism of claim 11 wherein said linkage includes a stop such that said linkage cannot be manipulated beyond a substantially straightened position when said bed rail is in the elevated position.

13. The mechanism of claim 12 wherein said stop is a projecting portion of said second link near said first ends.

14. The mechanism of claim 13 further including a means for biasing said linkage to a substantially straightened position.

15. The mechanism of claim 14 wherein said means for biasing is a spring which tends to bias said first link against the stop on said second link.

16. The mechanism of claim 10 further including a counterbalance device to counteract the weight of said bed rail.

17. The mechanism of claim 16 wherein said counterbalance device is a spring connected between said mounting bar and said stabilizer bar.

18. The mechanism of claim 10 further including a counterbalance spring connected between said mounting bar and said stabilizer bar to counteract the weight of said bed rail;

wherein said linkage is a first link pivotally connected at a first end to said stabilizer bar and pivotally connected at a second end to a first end of a second link that is pivotally connected at a second end to said mounting bar;

wherein said linkage includes a stop such that said linkage cannot be manipulated beyond a straightened position when said bed rail is in the elevated position; and wherein said linkage has a spring for biasing said linkage to a substantially straightened position.

19. A mechanism for connecting a bed rail to a bed frame such that the bed rail can be moved between a lowered position and a raised and locked position comprising:

a mounting means for attaching said mechanism to said bed frame;

a bed rail means for keeping an occupant of the bed from falling off said bed;

a first linkage means connected between said mounting means and said bed rail means to guide said bed rail means in an arcuate path between a lowered position and a raised and locked position, said first linkage means including at least one guiding arm, said arm having an end extending past said mounting means, generally away from said bed rail; and a second linkage means connected at one point to said arm end and connected at another point spaced from said one point to said mounting means for locking said mechanism in a raised position.

* * * * *